United States Patent [19]

Amos

[11] 4,020,611

[45] May 3, 1977

[54] WALL ASSEMBLY

[75] Inventor: Alvin C. Amos, Orwigsburg, Pa.

[73] Assignee: Kaiser Aluminum & Chemical Corporation, Oakland, Calif.

[22] Filed: Nov. 19, 1975

[21] Appl. No.: 633,181

[52] U.S. Cl. ..... 52/584; 49/DIG. 1; 52/417

[51] Int. Cl.[2] ..... E04B 1/62; E04B 2/00

[58] Field of Search ..... 52/582, 584, 417, 758 C, 52/393, 400, 309, 222; 49/DIG. 1

[56] References Cited

UNITED STATES PATENTS

| | | | |
|---|---|---|---|
| 3,093,217 | 6/1963 | Doede | 49/DIG. 1 |
| 3,332,170 | 7/1967 | Bangs | 49/DIG. 1 |
| 3,570,205 | 3/1971 | Payne | 52/584 |
| 3,583,118 | 6/1971 | Lowery | 52/417 |
| 3,916,503 | 11/1975 | Chenevert et al. | 49/DIG. 1 |

FOREIGN PATENTS OR APPLICATIONS

| | | | |
|---|---|---|---|
| 1,113,551 | 5/1961 | Germany | 49/DIG. 1 |

*Primary Examiner*—J. Karl Bell
*Attorney, Agent, or Firm*—Paul E. Calrow; John S. Rhoades

[57] ABSTRACT

Wall assembly comprised of laminated panels wherein each panel is provided with thermal break or barrier elements integrated and interconnected in an improved fashion with the interior and exterior members of a panel together with an improved joint arrangement between adjacent panels.

14 Claims, 7 Drawing Figures

WALL ASSEMBLY

BACKGROUND OF THE INVENTION

This invention relates to wall assemblies. More particularly it is concerned with providing an improved demountable and insulated wall system such as a curtain wall system made of composite thermal barrier wall panels that can be readily assembled and dismantled at the building site with a minimum amount of tools.

Various prefabricated curtain wall structures comprised of composite panels have been proposed in the past wherein each panel is provided with thermal barrier elements between the inside and outside wall components that make up the overall panel and which thermally isolate such components from each other. Such wall assemblages are represented in various prior art patents such as, for example, U.S. Pat. Nos. 2,781,111; 2,835,360; 2,654,920; 3,093,217; 3,092,214; 3,114,179; 3,204,324; 3,212,179; 3,420,026; 3,336,713, 3,624,885; 3,854,260; 3,908,313; Swiss Patent 356,265; German Patents 962,017; 1,117,290 and 1,174,483; and Sweet's Catalogue for 1971, Architectural File — Mirawal Laminated Building Panels 8.23/Mi, page 7.

These prior art wall structures, however, particularly when equipped with thermal barrier or break elements have been somewhat deficient in that the panel joints used in such structures had to be somewhat loose to facilitate assembly, provide for construction tolerances and allow for thermal movement. This looseness of the joints becomes aggravated in outside curtain wall structures under severe wind buffeting, and unless properly compensated for ultimately can impair the watertight integrity of the joint, the thermal insulation properties of the wall panels and the basic performance of the wall itself.

The instant wall assembly because of the improved structure of the individual panels used and the improved joint therebetween is well adapted for use in curtain wall structures assembled from composite wall panels and requiring ease of assembly, high resistance to deflection and good thermal insulation properties. The new and improved arrangement for aligning and connecting adjacent panels together along with the thermal barriers therebetween and the stiffened marginal panel edges all contribute to form a wall system of fully integrated and readily connectable composite panels. The stiffened marginal edges of adjacent panels and the interconnecting joint components advantageously help to align panels in the plane of the wall yet permit variation and movement of individual elements in other planes or directions. The instant wall joint assembly also constitutes improvements over those disclosed in U.S. Pat. Nos. 2,209,816; 2,912,725; 2,951,609; 2,918,993; 3,062,337; 3,303,619; 3,376,678; 3,583,118; 3,675,383; 3,574,449; 3,170,266 and Australian Patent 209,055.

SUMMARY OF INVENTION

The present invention is directed to an improved curtain wall system and the like and, in particular, to an improved arrangement for aligning and joining the stiffened marginal edges of composite building panels together in deflection resistant, shock absorbing and thermally isolated relation. In this joint assembly the opposed edges of adjacent panels are preferably provided with rails made from light metal extrusions. Each panel edge is comprised of a pair of such rails into which strips of insulating material are inserted and anchored in an improved fashion such that the extruded elements simulate I-beam flanges connected by a web of plastic insulating material or the like. Improved cap or cover elements interconnect adjacent panels in a snug interfitting relation and seal the joint therebetween. Pairs of the cover elements are used for each complete joint assembly and these cover elements are provided with openings or sockets for snugly receiving the various extruded rail members at the edges of the panels being joined.

DETAILED DESCRIPTION

Figure 1:
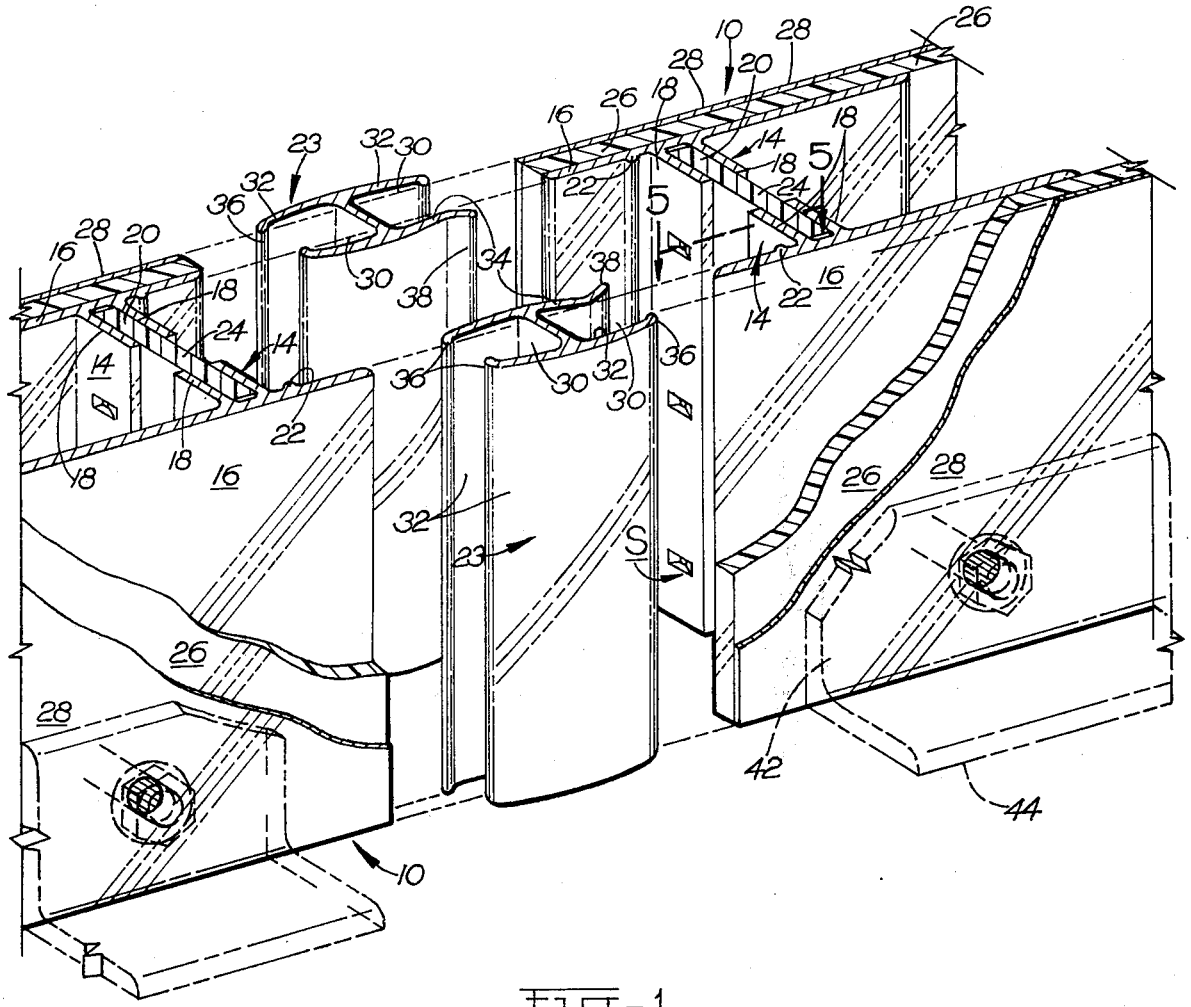
FIG. 1 is a fragmentary exploded isometric view of a wall system employing the improved joint assembly of the instant invention.
Figure 2:
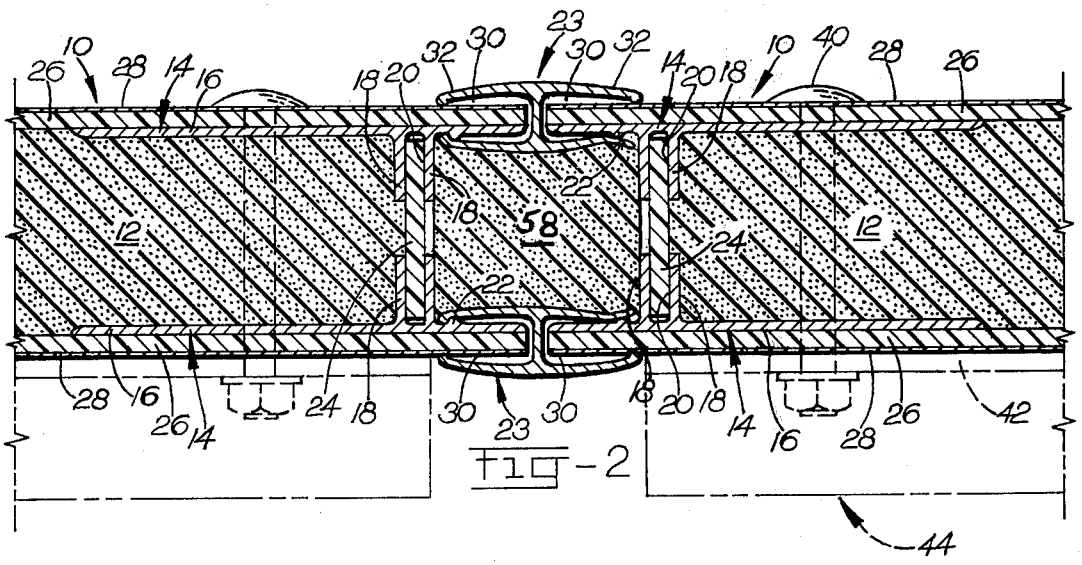
FIG. 2 is a cross-sectional view of the improved joint assembly of the invention.

With further reference to the drawings and, in particular, FIGS. 1 and 2, a wall structure incorporating the joint assembly of the instant invention can be generally comprised of a plurality of composite panels 10. Each of these panels can be made up of an interior insulating core 12, such as one of expanded perlite or other material having moisture and fire resistant properties. The opposing inside and outside surfaces of core member 12 are appropriately adhesively secured or bonded along each of the side marginal edges thereof to a pair of side rails 14 advantageously made up in the form of somewhat T-shaped light metal extrusions such as aluminum extrusions. The rails 14 are fabricated in such a fashion that they are provided with an outer base 16 from which a pair of legs 18 protrude inwardly in spaced relationship with each other so as to provide a recess or cavity 20. The individual rails can also be advantageously provided adjacent the junction of a leg 18 and base 16 with a tongue-like bead 22 formed integrally and easily with the base and legs 18 when a rail element is made in the form of a light metal extrusion. The beads 22 on one of the panels 10 making up a joint assembly have an important function during the time that panels 10 provided with rail elements 14 are joined together by an anchor clip and molding or cover element 23 in a manner to be hereinafter described.

After a pair of rail elements 14 are appropriately bonded to opposite sides of a panel core and to appropriate backer elements 26 along a given marginal side edge of the panel, they are thermally isolated yet integrated with each other in a unique fashion by means of a thermal barrier element 24. The thermal barrier element can comprise a strip of polypropylene having low thermal conductivity or the strip can be made of a fiberglass reinforced polyester or other similar materials. The thermal barrier element 24 is disposed in the channels 20 of the opposing rail elements and when locked in place in the manner disclosed in FIG. 5 by the rivet or stake arrangement S will serve to integrate a pair of opposing rails 14 and act as the web of a simulated I-beam resulting from the unification of rails 14 and a thermal barrier element or strip 24.

Thermal barrier elements 24, while being relatively stiff, have sufficient elasticity and resiliency to flex a certain amount during use without fracture. The structure of the composite panel is completed by affixing a final metal sheathing or covering 28 of porcelainized steel or anodized aluminum, etc. to the outside surfaces of the backer elements 26 made of a cement asbestos board or other similar material.

Figure 3:
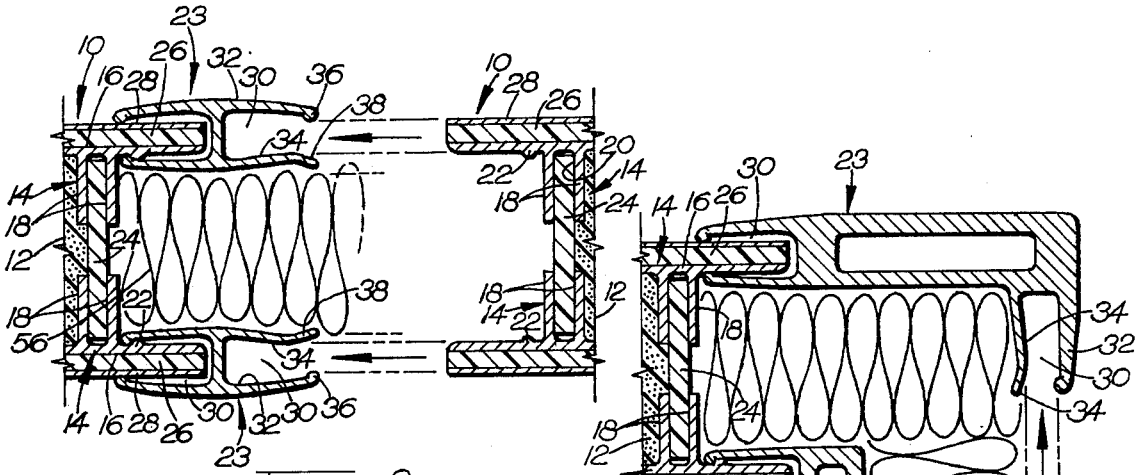
FIG. 3 is a sectional view of the partially assembled joint of FIG. 2 wherein alternate joint filler elements are used.
Figure 6:
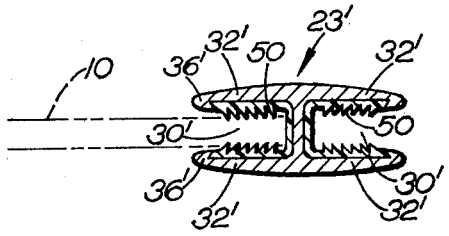
FIGS. 6 and 6A are elevational sectional views of modified joint cover strips that can be used in the practice of the instant invention.
Figure 6A:
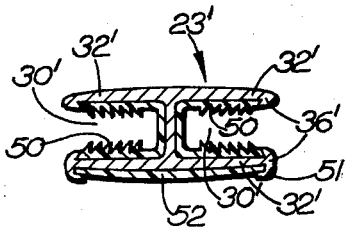

The reinforced and stiffened marginal edges of the adjoining panels can be assembled by means of a novel joint cover strip 23 equipped with openings or pockets 30 for receiving the marginal edges of adjoining panels. The cover strip in certain embodiments of the invention can have an approximate H-shape as indicated in FIGS. 3, 6 and 6A while in another embodiment as noted in FIG. 4 it can have a somewhat L-shape in cross-sectional configuration. The pockets 30 are defined or bounded by leg elements 32 including a specially configured leg element 34. In an advantageous embodiment of the invention at least the inner interior leg element 32 and, if desired, all of the leg elements 32 of a cover strip 23 can be provided with a beaded end or tongue element. The beaded end of an inner leg 32 is adapted to interengage or interlock with a tongue-like bead 22 on the composite panel rail 14 for a given panel for the purpose of interlocking a given cover strip with the panel structure rail 14 associated therewith. In the case of the cover strip leg element 34, this leg element is advantageously provided with an inwardly turned or deflected lip 38 so as to provide a divergent mouth on one of the pockets 30 and allow for ready insertion of the marginal edge of one of the panels within the pocket 30 provided with such a leg element 34. The clip or joint cover element 23 can likewise be advantageously made in the form of a light metal relatively stiff extrusion whereby the joint cover pocket 30 equipped with lip 38 can snugly receive the marginal edge of an adjoining panel while the stiffness of the extrusion inhibits deflection of the panel edge in such pocket. In the meantime, the interlock between the other panel and the other beaded walls of the cover strip stiffen and prevent deflection of this latter panel in the area of the joint.

Figure 5:
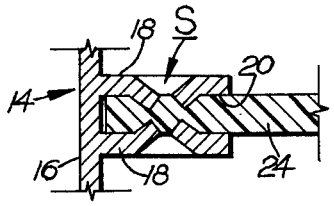
FIG. 5 is a partial cross-sectional view generally taken along the line 5—5 of FIG. 1 with parts removed and rotated 90° counterclockwise.

As indicated particularly in FIGS. 4 and 5, a preferred practice of the invention contemplates affixing a cover strip 23 by means of its interior beaded leg 32 to a fully installed panel 10 and, thereafter, using the pocket 30 of the cover strip equipped with the flaring lip 38 as a means for positioning and properly aligning a subsequently installed panel relative to the first-mentioned panel.

In addition to acting as a panel aligning and guide member for the wall panel assembly, the inwardly flaring lip 38 of a cover strip allows the lip to contact the rail of the associated and interfitting panel during expansion and contraction without binding, and while retaining a full or snug surface-to-surface contact therewith so that deflection of the said associated panel is discouraged, while still permitting or tolerating variations in the spacing between panels.

In further advantageous embodiments of the invention, the modified four legs 32' of the cover strips 23' can be provided as indicated in FIGS. 6 and 6A with squared-off retainer beading or tongue element 36'. Beads 36' serve to retain within the pockets 30' of the strip 23' saw tooth and U-shaped sealing gaskets 50 of a suitable elastomeric material such as neoprene, polyvinyl chloride, etc. Certain of the outer legs 32' of cover strip 23' as indicated in FIG. 6A can be further modified, if desired, so as to be provided with inturned fingers 51. These fingers can then serve as holders of a color strip insert 52 of metal, plastic, etc. in the event the same is desired. The inturned fingers 51 as in the case of beads 36' will normally extend for the full length of a strip 23'. As will be obvious, the use of sealing gaskets 50 will enhance the thermal properties of the joint assembly by helping to maintain the seal between the rail members 14 of the joined panels regardless of the normal flexing and movements of adjacent panels relative to each other due to thermal expansion and contraction of the various panel components, etc.

As indicated particularly in FIGS. 1 and 2, when the wall assembly above described is used as a curtain wall structure, one arrangement for mounting the same in place can include bolt elements 40. These bolt elements are adapted to be thrust completely through a panel and into a flange 42 of an L-shaped member 44 ultimately used to secure the panels to the standard framing of a building in a manner well known in the art.

Figure 4:
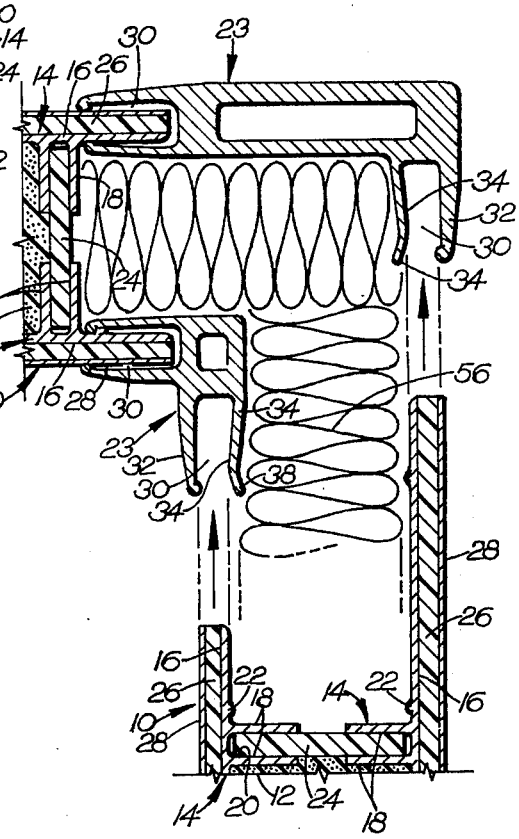
FIG. 4 is a view similar to FIG. 3 and indicates how the joint assembly of the instant invention can be used in corner structures.

With further reference to the drawings and particularly FIGS. 2, 3 and 4, it will be observed that the thermal properties of the wall structure in the area of the joint assembly between a pair of panels 10 can be enhanced by the use of the elongated ribbon-like strips of the fiberglass insulation 56 of FIGS. 3 and 4 and the foam block insulation 58 of FIG. 2. This joint insulation, when used, would ordinarily be emplaced before the final assembly of a pair of adjacent panels 10 by means of the cover strips 23.

An advantageous embodiment of the invention has been shown and described. Various changes may be made therein without departing from the scope of the claims, wherein:

What is claimed is:

1. In a demountable wall assembly of the type described, the combination of a pair of composite and adjacent wall panels each of which is provided with an insulating core and opposed stiffened side marginal edges, said marginal edges being fitted with opposed inside and outside metallic rail members, a tongue-like bead element on at least one of said rail members, a non-metallic thermal barrier element interconnecting the inside and outside metallic rail members located at the side marginal edge of a given panel to form a substantially integrated column-like marginal edge structure portions of which are thermally isolated from each other, means for joining together and in sliding relationship to each other the opposed rail members located along the same given sides of said pair of adjacent panels, said means comprising a cover strip provided with a pair of pockets and a tongue element that extends into one of said pockets, the said tongue element being slidingly interengageable with the tongue-like bead element on the one rail member of one panel and the other pocket of said cover strip being adapted to slidingly receive the rail member of the adjacent and opposing panel and said other pocket being further fitted with an inwardly deflected lip element that provides a divergent mouth on said other pocket that allows ready insertion of the rail member on the other opposing panel in said other pocket.

2. The wall assembly of claim 1 wherein each rail member of one panel is provided with a tongue-like element for interlockingly engaging a similar member on an associated cover strip.

3. The wall assembly of claim 1 wherein the cover strip comprises a light metal extrusion.

4. The wall assembly of claim 1 wherein the inside and outside rail members located at the side marginal edge of the said given panel are provided with recesses for receiving the opposing edges of the said non-metallic thermal barrier element.

5. The wall assembly of claim 4 wherein the cover strip is in the form of an H-shaped light metal extrusion.

6. The wall assembly of claim 4 wherein the cover strip is in the form of an L-shaped light metal extrusion.

7. The wall assembly of claim 1 wherein at least one of the pockets of the cover strip is lined with an elastomeric sealing means.

8. In a demountable wall assembly the combination of a pair of composite and adjacent wall panels each of which is provided with an insulated core and opposed side marginal edges, each side marginal edge being fitted with and stiffened by interconnected and opposed inside and outside metallic rail members, a bead-like tongue element projecting inwardly from at least one of said rail members, sheeting applied to each of said cores and the exterior surfaces of the inside and outside rail members, non-metallic thermal barrier elements inserted and interlocked in recesses of the opposed inside and outside rail members of a given panel and acting to interconnect said inside and outside rail members in a column-like structure portions of which are thermally insulated from each other, cover strip means for joining the opposed side marginal edges of the said adjacent panels together, said cover strip means being provided with pocket portions for selectively receiving certain portions of the rail members on the adjacent panels, said cover strip means being provided with a tongue element in one of said pocket portions which is interengageable with the bead-like tongue element on the said one of the rail members of one of the panels making up the wall assembly said cover strip means also having an inwardly flaring lip element on another pocket portion which provides a divergent mouth on said last mentioned pocket portion for loosely and slidably engaging the rail member on the other panel.

9. The wall assembly of claim 8 wherein the cover strip means and rail members comprise light metal extrusions.

10. The wall assembly of claim 8 wherein a pocket portion of the cover strip means is provided with an elastomeric sealing means.

11. The wall assembly of claim 8 wherein the cover strip means is in the form of an H-shaped light metal extrusion.

12. The wall assembly of claim 8 wherein the cover strip means is in the form of an L-shaped light metal extrusion.

13. The wall assembly of claim 1, including insulating material disposed in the joint between the adjacent wall panels.

14. The wall assembly of claim 8 including insulating material disposed in the joint between the adjacent wall panels.

* * * * *